US007570780B2

(12) United States Patent
Baeten

(10) Patent No.: US 7,570,780 B2
(45) Date of Patent: Aug. 4, 2009

(54) LOUDSPEAKER HAVING A COMPOSITE DIAPHRAGM STRUCTURE

(75) Inventor: Jozef Arnold Frans Baeten, Dendermonde (BE)

(73) Assignee: PSS Belgium N.V., Dendermonde (BE)

( * ) Notice: Subject to any disclaimer, the term of this patent is extended or adjusted under 35 U.S.C. 154(b) by 492 days.

(21) Appl. No.: 10/568,647

(22) PCT Filed: Aug. 6, 2004

(86) PCT No.: PCT/IB2004/051413

§ 371 (c)(1),
(2), (4) Date: Feb. 16, 2006

(87) PCT Pub. No.: WO2005/020630

PCT Pub. Date: Mar. 3, 2005

(65) Prior Publication Data

US 2006/0256996 A1 Nov. 16, 2006

(30) Foreign Application Priority Data

Aug. 22, 2003 (EP) ..... 03103214

(51) Int. Cl.
*H04R 9/06* (2006.01)

(52) U.S. Cl. ..... 381/423; 381/430

(58) Field of Classification Search ..... 381/420, 381/423, 430; 181/148, 157, 165
See application file for complete search history.

(56) References Cited

U.S. PATENT DOCUMENTS 6,757,404 B2 * 6/2004 Takewa et al. ..... 381/430

FOREIGN PATENT DOCUMENTS

JP 02-043895 * 2/1990

* cited by examiner

*Primary Examiner*—Brian Ensey
(74) *Attorney, Agent, or Firm*—Sheehan Phinney Bass & Green, PA; Peter A. Nieves

(57) ABSTRACT

A shallow loudspeaker provided with a chassis (2), a movable body (4), a resilient suspension for guiding the movable body with respect to the chassis along a translation axis (T), and an electric actuator (6) for driving the movable body along the translation axis. The movable body has a diaphragm structure comprising a central domeshaped diaphragm (8) and a cone-shaped diaphragm (10) concentrically arranged with respect to the dome-shaped diaphragm. The cone-shaped diaphragm has a back portion ($\mathbf{10}_b$) and a front portion ($\mathbf{10}_f$) which is wider than the back portion. Both diaphragms are attached to each other near the back portion of the cone-shaped diaphragm, the cone-shaped diaphragm enveloping the dome-shaped diaphragm. The resilient suspension comprises a first resilient element (12*a*) connecting the diaphragm structure to the chassis near the back portion of the cone-shaped diaphragm, and a second resilient element (12*b*) connecting the diaphragm structure to the chassis near the front portion of the cone-shaped diaphragm.

7 Claims, 2 Drawing Sheets

LOUDSPEAKER HAVING A COMPOSITE DIAPHRAGM STRUCTURE

FIELD OF THE INVENTION

The invention relates to a loudspeaker provided with a chassis, a movable body, a resilient suspension for guiding the movable body with respect to the chassis along a translation axis, and an electric actuator for driving the movable body along the translation axis.

BACKGROUND OF THE INVENTION

Speakers of such a type are generally known; e.g. PCT Patent Application WO 96/14722 discloses such a loudspeaker. This known loudspeaker has a frame, a membrane and an electromagnetic driving unit. The membrane is formed by a conical body and has an outer circumferential edge and an inner circumferential edge. The driving unit is provided with a stationary part and a movable part. The stationary part includes a permanent magnet and a magnetic yoke and is secured to the frame. The movable part includes a voice coil and a cylindrical coil support. At its outer circumferential edge, the membrane is connected to the frame by means of a flexible suspension and, at its inner circumferential edge, it is adhered to the coil support, which in its turn is connected to the frame by means of a spider.

The conical membrane of the known loudspeaker has a certain height in order to obtain sufficient stiffness. The membrane must have a certain minimal stiffness in order to be able to move like a piston, not only for low frequency reproduction but for the whole or at least the larger part of the audio spectrum.

For this reason, there arise problems relating to the speaker's performance when a shallow speaker, i.e. a speaker having a small height, is required in certain applications.

It is an object of the invention to improve the known loudspeaker in such a way that it can be given a small height without degrading its sound performance.

SUMMARY OF THE INVENTION

This object is achieved with the loudspeaker according to the invention, which is provided with a chassis, a movable body, a resilient suspension for guiding the movable body with respect to the chassis along a translation axis, and an electric actuator for driving the movable body along the translation axis, which movable body has a diaphragm structure comprising a centrally situated dome-shaped diaphragm and a decentralized cone-shaped diaphragm concentrically arranged with respect to the dome-shaped diaphragm, which cone-shaped diaphragm has a back portion and a front portion which is wider than the back portion, wherein both diaphragms are attached to each other near the back portion of the cone-shaped diaphragm, the cone-shaped diaphragm enveloping the dome-shaped diaphragm, and wherein the resilient suspension comprises a resilient element connecting the diaphragm structure to the chassis near the back portion of the cone-shaped diaphragm, and a further resilient element connecting the diaphragm structure to the chassis near the front portion of the cone-shaped diaphragm.

Thus, the loudspeaker according to the invention has a diaphragm structure which is composed of an outwardly convex, particularly dome-shaped, diaphragm and a cone-shaped diaphragm situated around the other diaphragm. This makes it possible to give the diaphragm structure of the movable body sufficient stiffness to prevent an undesired break-up, i.e.

bending wave resonances, during mid and high-frequency reproduction in relatively flat loudspeaker constructions. In principle, a cone-shaped diaphragm known per se may be used. The same applies to the dome-shaped diaphragm. A rigid dome-shaped diaphragm known per se may be used. Such diaphragms are known, for instance, from U.S. Pat. No. 3,925,626. The loudspeaker according to the invention can be driven by a usual audio transformer of an amplifier system known per se.

A favorable embodiment of the loudspeaker according to the invention has the characteristic feature that the electric actuator comprises a stationary part which is secured to the chassis or to a stationary element fixed to the chassis and further comprises a translatable part which is secured to the dome-shaped diaphragm. Due to this feature, the translatable part of the electric actuator extends into the space enveloped by the dome-shaped diaphragm.

It is to be noted that said U.S. Pat. No. 3,925,626 discloses an all-frequency loudspeaker which has a domed diaphragm instead of the usual cone diaphragm of the prior art in order to get, inter alia, a high-fidelity sound. Secured to the underside of the diaphragm is a form which extends downwards into an air gap formed by a pole piece and a topring of a magnet system and on which a voice coil has been wound. The device formed by the diaphragm and the form is suspended from a framework by means of a resilient suspension secured to both the diaphragm and the framework and a resilient support secured to both the form and the framework. A disadvantage of this known loudspeaker is its height, which has to be substantial in order to provide sufficient distance between the lower resilient support and the topring to realize the required travel of the diaphragm. Contrary to the known devices, the loudspeaker according to the invention has no suspension means secured to the coil support, and thus does not have the above-described disadvantage.

In a practical embodiment of the loudspeaker according to the invention, the back portion of the cone-shaped diaphragm includes an inner circumferential edge to which an outer circumferential rim of the dome-shaped diaphragm is connected, said edge and rim being preferably attached to each other by means of an adhesive, such as a glue. In this context it is also preferred to connect an inner circumferential brim of the resilient element of the resilient suspension to the inner circumferential edge of the cone-shaped diaphragm and/or to the outer circumferential rim of the dome-shaped diaphragm. This can also be realized by means of a suitable adhesive.

In another practical embodiment, the stationary part includes a magnetic yoke with a permanent magnet and the translatable part includes a coil support with a voice coil, which coil extends in an air gap of the magnetic yoke and has a coil axis coinciding with the translation axis of the movable body.

It is to be noted that the loudspeaker according to the invention is suitable for sound reproduction in hifi, home, automotive, TV and multimedia systems and, as already indicated, is particularly suitable for applications having very small built-in depths.

The invention also relates to a diaphragm structure intended for use in the loudspeaker according to the invention. Particularly, the diaphragm structure according to the invention has the characterizing feature that it is composed of a central dome-shaped diaphragm and a cone-shaped diaphragm concentrically arranged with respect to the dome-shaped diaphragm.

The invention further relates to a loudspeaker unit comprising the loudspeaker according to the invention and also comprising a housing accommodating the loudspeaker.

It is noted in relation to the claims that various combinations of characteristic features defined in the claims are possible.

The above-mentioned and other aspects of the invention are apparent from and will be elucidated, by way of non-limitative examples, with reference to the embodiment described hereinafter.

DETAILED DESCRIPTION

Figure 1:
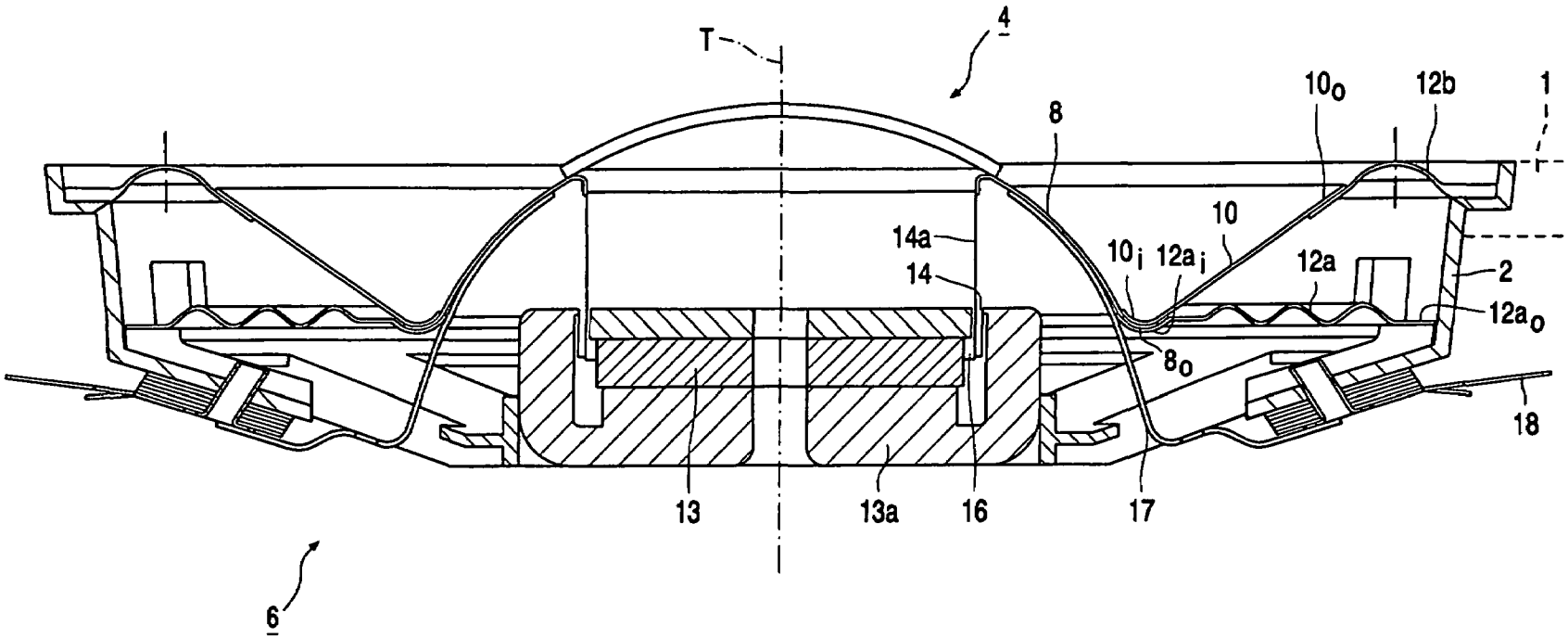
FIG. 1 shows an embodiment of the loudspeaker according to the invention in a diagrammic cross-section.
Figure 2:
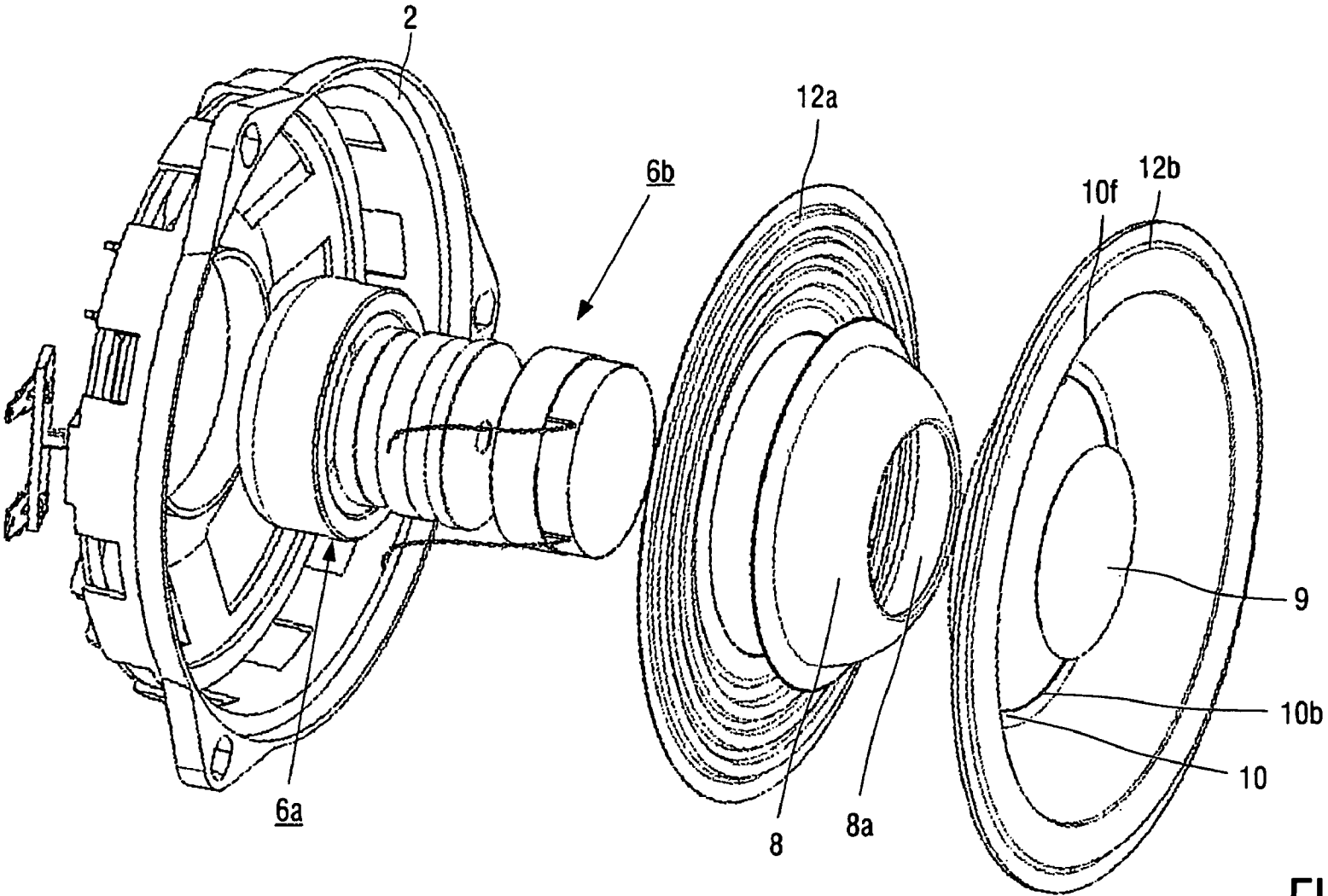
FIG. 2 is a perspective elevational view of the loudspeaker of FIG. 1 in an exploded view.

The electrodynamic loudspeaker according to the invention, shown in the Figures, comprises a chassis 2, a movable body 4 and an electromagnetic actuator 6. For forming a loudspeaker unit according to the invention, the loudspeaker may be accommodated in a housing. To this end, the chassis 2 may be fixed in an appropriate opening in a wall of this housing. In FIG. 1, the housing is shown diagrammatically by means of a wall section 1 in broken lines.

The movable body 4 has a three-dimensional diaphragm structure comprising a central dome-shaped diaphragm 8 and a cone-shaped diaphragm 10 concentrically arranged with respect to the dome-shaped diaphragm 8. The dome-shaped diaphragm 8 may be made of a metal, such as aluminium; reinforced plastics; pressed paper; or any other suitable material. The diaphragm 8 has a sufficient stiffness and may be provided with a central opening 8*a* covered by a dust cap 9 of any suitable material, such as paper, plastics, or textile. The cone-shaped diaphragm 10 may be made of pressed paper, carbon fiber, polyglass, aluminium, or any other suitable material. The cone-shaped diaphragm 10 has a back portion $\mathbf{10}_b$ and a front portion $\mathbf{10}_f$ which is wider than the back portion $\mathbf{10}_b$. The dome-shaped diaphragm 8 and the cone-shaped diaphragm 10 are mutually secured at the back portion $\mathbf{10}_b$. For this reason, the cone-shaped diaphragm 10 has an inner circumferential edge $\mathbf{10}_i$, while the dome-shaped diaphragm 8 has a corresponding outer circumferential rim $\mathbf{8}_o$. The edge 10*i* and the rim $\mathbf{8}_o$ preferably have round cross-sections so that the edge $\mathbf{10}_i$ and the rim $\mathbf{8}_o$ fit each other. The edge $\mathbf{10}_i$ and the rim $\mathbf{8}_o$ are preferably glued to each other.

The loudspeaker further comprises a resilient suspension for suspending the movable body 4 from the chassis 2 and for guiding the movable body along a translation axis T. The suspension includes a first resilient element 12*a* and a second resilient element 12*b*. The first resilient element 12*a* is a ring-like spider, an inner circumferential brim $\mathbf{12}a_i$ of which is attached to the edge $\mathbf{10}_i$ and/or the rim $\mathbf{8}_o$ and an outer circumferential brim $\mathbf{12}a_o$ is attached to the chassis 2. A glue may be used for both attachments. The spider 12*a* may be a known flexible corrugated body and ensures that the movable body 4 can perform well-defined translation movements with respect to the chassis 2.

The second resilient element 12*b* has a roll structure known per se and is formed, for example, from a bent rubber or foam annular strip. On its outer circumference, the second element 12*b* is secured, for example glued, to the chassis 2 and on its inner circumference to an outer circumferential edge $\mathbf{10}_o$ of the cone-shaped membrane 10.

The actuator 6 essentially comprises two elements, namely a stationary actuator part 6*a* which is fixed to the chassis 2 and a translatable actuator part 6*b* which is connected to the movable body 4. One of the actuator parts—in this example the part 6*a*—is provided with a permanent magnet 13, in this example annular in shape and axially polarized, and the other actuator part—in this example the part 6*b*—is provided with a magnet coil 14. The permanent magnet 13 is formed from a neodymium-iron-boron alloy and forms a magnetic yoke 13*a* with soft iron portions of the stationary actuator part 6*a*, which yoke defines an air gap 16. The magnet coil 14, being a cylindrical coil, also referred to as voice coil, is situated on a coil support 14*a*, being a sleeve in this example, which is fixed to the dome-shaped diagram 8. A lead wire 17 connects the coil 14 by means of a connector 18 which is adhered to the chassis 2. When energizing the coil 14, both actuator parts 6*a*, 6*b* magnetically co-operate with each other over the air gap 16 for generating a driving force on the movable body 4 parallel to the translation axis T and thus on the dome-shaped diaphragm 8 and the cone-shaped diaphragm 10.

It is to be noted that the invention is not limited to the embodiment shown. For example, the dome-shaped diaphragm and the cone-shaped diaphragm may be formed as an integral combination, thus comprising or consisting of a single diaphragm structure. Moreover, the loudspeaker unit may not only comprise one or more speakers but also one or more passive radiators or bass reflex ports. Furthermore, the loudspeaker according to the invention is not limited to a certain power. For acoustical sound tuning purposes, the dome-shaped diaphragm may be provided with perforations and/or a coating. For the same purposes, the outer circumferential rim of the dome-shaped diaphragm does not need to be a back portion of the dome-shaped diaphragm, but may be a rim parallel to the back portion.

The invention claimed is:

1. A loudspeaker provided with a chassis, a movable body, a resilient suspension for guiding the movable body with respect to the chassis along a translation axis, and an electric actuator comprising a stationary part and a translatable part for driving the movable body along the translation axis, which movable body has a diaphragm structure comprising a central dome-shaped diaphragm and a cone-shaped diaphragm concentrically arranged with respect to the dome-shaped diaphragm, which cone-shaped diaphragm has a back portion and a front portion which is wider than the back portion, wherein a rim of the dome-shaped diaphragm is attached to a back edge of the back portion of the cone-shaped diaphragm, the cone-shaped diaphragm enveloping the dome-shaped diaphragm, the resilient suspension comprises a resilient element connecting the diaphragm structure to the chassis near the back portion of the cone-shaped diaphragm, and a further resilient element connecting the diaphragm structure to the chassis near the front portion of the cone-shaped diaphragm, and wherein the translatable part of the actuator extends into a space enveloped by the dome-shaped diaphragm.

2. A loudspeaker as claimed in claim 1, wherein the stationary part of the electric actuator is secured to the chassis and the translatable part is secured to the dome-shaped diaphragm.

3. A loudspeaker as claimed in claim 1, wherein the back portion of the cone-shaped diaphragm includes an inner circumferential edge to which an outer circumferential rim of the dome-shaped diaphragm is connected.

4. A loudspeaker as claimed in claim 3, wherein the resilient element of the resilient suspension includes an inner circumferential brim which is connected to the inner circumferential edge of the cone-shaped diaphragm and/or the outer circumferential rim of the dome-shaped diaphragm.

5. A loudspeaker as claimed in claim 2, wherein the stationary part includes a magnetic yoke with a permanent magnet and the translatable part includes a coil support with a voice coil, which coil extends in an air gap of the magnetic yoke and has a coil axis coinciding with the translation axis of the movable body.

6. A diaphragm structure constructed and evidently intended for use in the loudspeaker as claimed in any one of the preceding claims, the diaphragm structure comprising a central dome-shaped diaphragm and a cone-shaped diaphragm concentrically arranged with respect to the dome-shaped diaphragm, which cone-shaped diaphragm has a back portion and a front portion which is wider than the back portion, wherein a rim of the dome-shaped diaphragm is attached to the back edge of the back portion of the cone-shaped diaphragm, the cone-shaped diaphragm enveloping the dome-shaped diaphragm, and wherein the dome-shaped diaphragm envelopes a space in which to accommodate a translatable part of an electric actuator.

7. A loudspeaker unit comprising the loudspeaker as claimed in claim 1 and comprising a housing accommodating the loudspeaker.

* * * * *